US007979163B2

(12) United States Patent
Terlson et al.

(10) Patent No.: US 7,979,163 B2
(45) Date of Patent: Jul. 12, 2011

(54) DEVICES AND METHODS FOR PROVIDING CONFIGURATION INFORMATION TO A CONTROLLER

(75) Inventors: Brad A. Terlson, Maple Grove, MN (US); Charles E. Bartlett, St. Louis Park, MN (US); Leisha J. Rotering, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 607 days.

(21) Appl. No.: 11/750,744

(22) Filed: May 18, 2007

(65) Prior Publication Data

US 2007/0225868 A1 Sep. 27, 2007

Related U.S. Application Data

(63) Continuation of application No. 10/883,075, filed on Jul. 1, 2004, now abandoned, and a continuation-in-part of application No. 11/276,873, filed on Mar. 17, 2006, now Pat. No. 7,475,828, which is a continuation of application No. 10/758,838, filed on Jan. 16, 2004, now Pat. No. 7,044,397.

(51) Int. Cl.
*G05D 23/00* (2006.01)
*F24F 7/00* (2006.01)

(52) U.S. Cl. ..... 700/276; 700/17; 700/83; 236/49.3

(58) Field of Classification Search ..... 165/223, 165/244; 236/49.3; 700/17, 83, 86, 87, 276–278
See application file for complete search history.

(56) References Cited

U.S. PATENT DOCUMENTS

| | | | |
|---|---|---|---|
| 2,495,861 | A | 1/1950 | Newton |
| 2,882,383 | A | 4/1959 | Boyd, Jr. et al. |
| 3,454,078 | A | 7/1969 | Elwart |
| 3,635,044 | A | 1/1972 | Heth |
| 3,948,438 | A | 4/1976 | Vlasak |
| 4,011,735 | A | 3/1977 | Martz et al. |

(Continued)

FOREIGN PATENT DOCUMENTS

WO 02061344 8/2002

OTHER PUBLICATIONS http://content.honeywell.com/yourhome/ptc-thermostats/PC8900faq.htm, Honeywell, Your Home Expert—Programmable Thermostats: FAQ, 10 pages, printed Feb. 4, 2004.

(Continued)

*Primary Examiner* — Albert Decady
*Assistant Examiner* — Douglas S Lee
(74) *Attorney, Agent, or Firm* — Seager Tufte & Wickhem LLC

(57) ABSTRACT

A controller equipped with a controller interface configured to accept one or more input parameters is disclosed, including methods for programming such devices. An illustrative controller interface may include a number of knobs, slides, buttons, or other input means for setting various set-points within the controller that can be used to control one or more HVAC system components of a building or structure. The input parameters may correspond directly to physical parameters of the building or structure being regulated, allowing the user to program the controller without having an extensive knowledge of HVAC systems or their operation.

53 Claims, 10 Drawing Sheets

U.S. PATENT DOCUMENTS

| | | | | |
|---|---|---|---|---|
| 4,075,864 | A | 2/1978 | Schrader | |
| 4,136,822 | A | 1/1979 | Felter | |
| 4,267,967 | A | 5/1981 | Beck et al. | |
| 4,356,962 | A | 11/1982 | Levine | |
| 4,369,916 | A | 1/1983 | Abbey | |
| 4,408,711 | A | 10/1983 | Levine | |
| 4,452,391 | A | 6/1984 | Chow | |
| 4,467,617 | A | 8/1984 | Morgan, Jr. et al. | |
| 4,502,625 | A | 3/1985 | Mueller | |
| 4,571,950 | A | 2/1986 | Nariai et al. | |
| 4,595,139 | A | 6/1986 | Levine | |
| 4,684,060 | A | 8/1987 | Adams et al. | |
| 4,718,021 | A | 1/1988 | Timblin | |
| 4,742,475 | A | 5/1988 | Kaiser et al. | |
| 4,773,587 | A | 9/1988 | Lipman | |
| 4,776,385 | A | 10/1988 | Dean | |
| 4,838,482 | A | 6/1989 | Vogelzang | |
| 4,930,460 | A | 6/1990 | Aihara et al. | |
| 4,941,325 | A | 7/1990 | Nuding | |
| 4,951,473 | A | 8/1990 | Levine et al. | |
| 5,020,332 | A | 6/1991 | Nakatsumo et al. | |
| 5,131,236 | A | 7/1992 | Wruck et al. | |
| 5,142,880 | A | 9/1992 | Bellis | |
| 5,179,524 | A | 1/1993 | Parker et al. | |
| 5,239,854 | A | 8/1993 | Hinson | |
| 5,241,253 | A | 8/1993 | Schlangen | |
| 5,282,770 | A | 2/1994 | Shibata | |
| 5,325,286 | A | 6/1994 | Weng et al. | |
| 5,415,617 | A | 5/1995 | Kraus | |
| 5,433,377 | A | 7/1995 | Sodo et al. | |
| 5,492,273 | A | 2/1996 | Shah | |
| 5,547,017 | A | 8/1996 | Rudd | |
| 5,579,993 | A | 12/1996 | Ahmed et al. | |
| 5,707,005 | A | 1/1998 | Kettler et al. | |
| 5,727,887 | A | 3/1998 | Webster et al. | |
| 5,742,516 | A | 4/1998 | Olcerst | |
| 5,791,408 | A | 8/1998 | Seem | |
| 5,803,804 | A * | 9/1998 | Meier et al. | 454/256 |
| 5,862,982 | A | 1/1999 | Federspiel | |
| 5,881,806 | A | 3/1999 | Rudd | |
| 5,884,806 | A | 3/1999 | Boyer et al. | |
| 5,902,183 | A | 5/1999 | D'Souza | |
| 5,971,846 | A | 10/1999 | Cho et al. | |
| 6,079,627 | A | 6/2000 | Kettler | |
| 6,161,764 | A | 12/2000 | Jatnieks | |
| 6,170,271 | B1 | 1/2001 | Sullivan | |
| 6,179,627 | B1 | 1/2001 | Daly et al. | |
| 6,241,156 | B1 * | 6/2001 | Kline et al. | 236/49.3 |
| 6,318,639 | B1 | 11/2001 | Toth | |
| 6,415,617 | B1 | 7/2002 | Seem | |
| 6,431,268 | B1 | 8/2002 | Rudd | |
| 6,467,695 | B1 | 10/2002 | Riley et al. | |
| 6,514,138 | B2 | 2/2003 | Estepp | |
| 6,609,967 | B2 | 8/2003 | Sharp et al. | |
| 6,644,557 | B1 | 11/2003 | Jacobs | |
| 6,698,219 | B2 | 3/2004 | Sekhar et al. | |
| 6,779,735 | B1 | 8/2004 | Onstott | |
| 6,988,671 | B2 | 1/2006 | DeLuca | |
| 7,016,744 | B2 | 3/2006 | Howard et al. | |
| 7,044,397 | B2 * | 5/2006 | Bartlett et al. | 236/49.3 |
| 2002/0072322 | A1 * | 6/2002 | Sharp et al. | 454/229 |
| 2003/0115163 | A1 * | 6/2003 | Moore et al. | 705/500 |
| 2003/0229404 | A1 * | 12/2003 | Howard et al. | 700/17 |
| 2005/0234596 | A1 | 10/2005 | Rietschel | |

OTHER PUBLICATIONS

Ashrae Standard, "Ventilation and Acceptable Indoor Air Quality in Low-Rise Residential Buildings," BSR/ASRAE Standard 62.2P, Fourth Public Review, Nov. 2002.

Honeywell Inc., "Field Demonstration of a Residential Ventilation Controller," EPRI Research Project 3512-04, Final Report, Mar. 1995.

Honeywell, "Perfect Climate Comfort Center," Quick Guide, 6 pages, 1996.

Honeywell Inc., "Perfect Climate Comfort Center," Owners Guide, 44 pages, 1998.

Honeywell Inc., "Residential Ventilation Control," EPRI Research Project 2034-44, May 1993.

Lifebreath, "Current Events Fall Edition," 4 pages, Sep. 1999.

Lipidex Corporation, "AirCycler, Improving Indoor Air Quality," 23 pages, printed Sep. 8, 2003.

Nutech Energy Systems Inc., "Lifebreath Clean Air Furnace "Electric" Clean Air Furnace Manual Model 60ELE" pp. 1-18, downloaded Feb. 5, 2004.

Nutech Energy Systems Inc., "Programmable ventilation Controller 99-105," Operation and Installation Manual, 4 pages, downloaded Feb. 4, 2004.

Nutech Energy Systems Inc., "Operating Your Ventilation Dehumidistat," Operating the 99-250 Ventilation Dehumidistat, 2 pages, downloaded Feb. 4, 2004.

These References Have Been Previously Provided in U.S. Appl. No. 10/883,075, filed Jul. 1, 2004.

Aprilaire, "Ventilation Control System Model 8126," 1 page, Jun. 2003.

Aprilaire, "Fresh Air Intake Installation Instructions," 1 page, May 2002.

Aprillaire, "Ventillation Controller Safety & Installation Instructions," 4 pages, prior to Jul. 1, 2004.

Aprilaire, "Ventilation Controller," Model 8120 Ventilation Controller, Owner's Manual, 2 pages, downloaded Feb. 4, 2004.

http://www.aricycler.com/frv.html, "AirCycler—The Indoor Air Quality Solution," 2 pages, printed Feb. 4, 2004.

http://www.aircycler.com/instfrv.htm, "AirCycler FR-V Installation," 2 pages, printed Feb. 4, 2004.

http://www.aircycler.com/instfrv.htm, "FR-Installation," 3 pages, printed Feb. 4, 2004.

Global Energy Group Inc., "Inventor Series 1400 Installation/Operation/Maintenance Manual," 73 pages, 2002.

Metasys, "Application Specific Controllers Technical Manual 636.3, Zone Terminal Section," pp. 1-28, 1995.

Metasys, "Metasys Network Sales Resource Manual 635, Application Specific Unitary Controller (UNT)," pp. 1-8, Feb. 1995.

* cited by examiner

DEVICES AND METHODS FOR PROVIDING CONFIGURATION INFORMATION TO A CONTROLLER

This application is a continuation of prior U.S. application Ser. No. 10/883,075 filed Jul. 1, 2004, and a continuation-in-part of prior U.S. application Ser. No. 11/276,873 filed Mar. 17, 2006, which is a continuation of U.S. application Ser. No. 10/758,838 filed Jan. 16, 2004, issued as U.S. Pat. No. 7,044,397.

FIELD OF THE INVENTION

The present invention relates to the field of heating, ventilation, and air conditioning (HVAC). More specifically, the present invention relates to controller interfaces and methods for providing configuration information to a controller.

BACKGROUND

Recent increases in fuel costs and efficiency standards have prompted the use of improved construction materials in homes and office buildings. While the advent of these new construction materials has led to a reduction in energy consumption used by many HVAC systems, there is often an insufficient amount of fresh air available within the controlled structure. The lack of fresh air within the structure can lead to an excess amount of humidity and elevated levels of carbon dioxide, radon gasses, volatile organic compounds (VOC's), and other toxins, affecting the comfort and health of the occupants. In some circumstances, the lack of fresh air can also affect the ability of the HVAC system to function efficiently, increasing the operating cost of the system.

To counter these effects, many HVAC systems include a ventilation unit to introduce fresh air ventilation into the structure. In certain HVAC systems, for example, the ventilation unit may be provided as part of an air conditioner, heater, and/or humidifier/dehumidifier unit used to regulate the temperature and/or humidity within the structure. Typically, the ventilation unit includes one or more air intake and/or exhaust fans that can be activated to channel fresh air into the structure to supplant the existing air. A damper mechanism may be employed to channel air through one or more ducts and/or vents, allowing fresh air to be introduced at selective locations within the structure. In some designs, the ventilation unit may also include a filtration system to filter airborne contaminants that can further diminish the air quality within the structure.

The HVAC system can be equipped with a controller that monitors and regulates the operation of the various system components. The controller may be configured as a stand-alone unit to run all of the components within the system, or can be configured to run selective components along with one or more other controllers within the system. In either design, the controller may include a processor unit such as a CPU/microprocessor that can be configured to receive a number of input parameters that can be used to control one or more system components in a particular manner.

To ensure that the HVAC system provides a sufficient amount of ventilation, a number of organizations have created standards that utilize a number of physical parameters based on the particular building or structure to be ventilated. The American Society of Heating, Refrigerating and Air-Conditioning Engineers (ASHRAE®), for example, has promulgated Standard 62.2-2003, which provides a standard for the amount of ventilation to be maintained within homes based on the total size of the home to be conditioned, and the number of bedrooms or occupants within the home. When implemented properly, these standards provide a means for meeting certain minimum ventilation requirements without over-ventilating the structure, allowing the ventilation unit to provide an acceptable amount of fresh air while conserving energy.

Despite improvements in ventilation standards, installation and programming of the controller still remains a significant obstacle for many users. Adjustment of many prior-art controllers often requires the user to have a threshold understanding of HVAC systems and their operation. In certain designs, for example, the controller may require the user to refer to a table and/or calculate a value and then subsequently input a setup code or other meaningless number into the controller. Since the inputted code or number does not readily correlate with a known physical value, such programming methods are not always intuitive to the user. As a result, such devices are more prone to user error. Accordingly, there is a need in the art to provide a controller equipped with a simplified controller interface that allows the user to input known physical parameters and/or constants directly into the controller.

SUMMARY

The present invention relates to controller interfaces and methods for providing configuration information to a controller. A controller interface in accordance with an illustrative embodiment of the present invention can include a number of input selectors adapted to accept various set-point values that can be used to control one or more system components. The controller interface can be configured to accept set-point values relating to one or more physical parameters of the building or structure to be controlled, allowing the user to program the controller without having an extensive knowledge of HVAC systems or their operation. In certain embodiments, for example, the controller interface can be configured to accept a ventilation airflow rate input parameter, an area input parameter, and a number of bedrooms input parameter. A number of knobs, slides, buttons, touchscreen and/or other input means may be provided to permit the user to adjust the set-point values for each input parameter, as desired.

DETAILED DESCRIPTION

The following description should be read with reference to the drawings, in which like elements in different drawings are numbered in like fashion. The drawings, which are not necessarily to scale, depict illustrative embodiments and are not intended to limit the scope of the invention. Although examples of various programming and operational steps are illustrated in the various views, those skilled in the art will recognize that many of the examples provided have suitable alternatives that can be utilized. While the various devices, systems and methods illustrated herein are described specifically with respect HVAC systems, it should be understood that the present invention could be employed in other systems, as desired.

Figure 1:
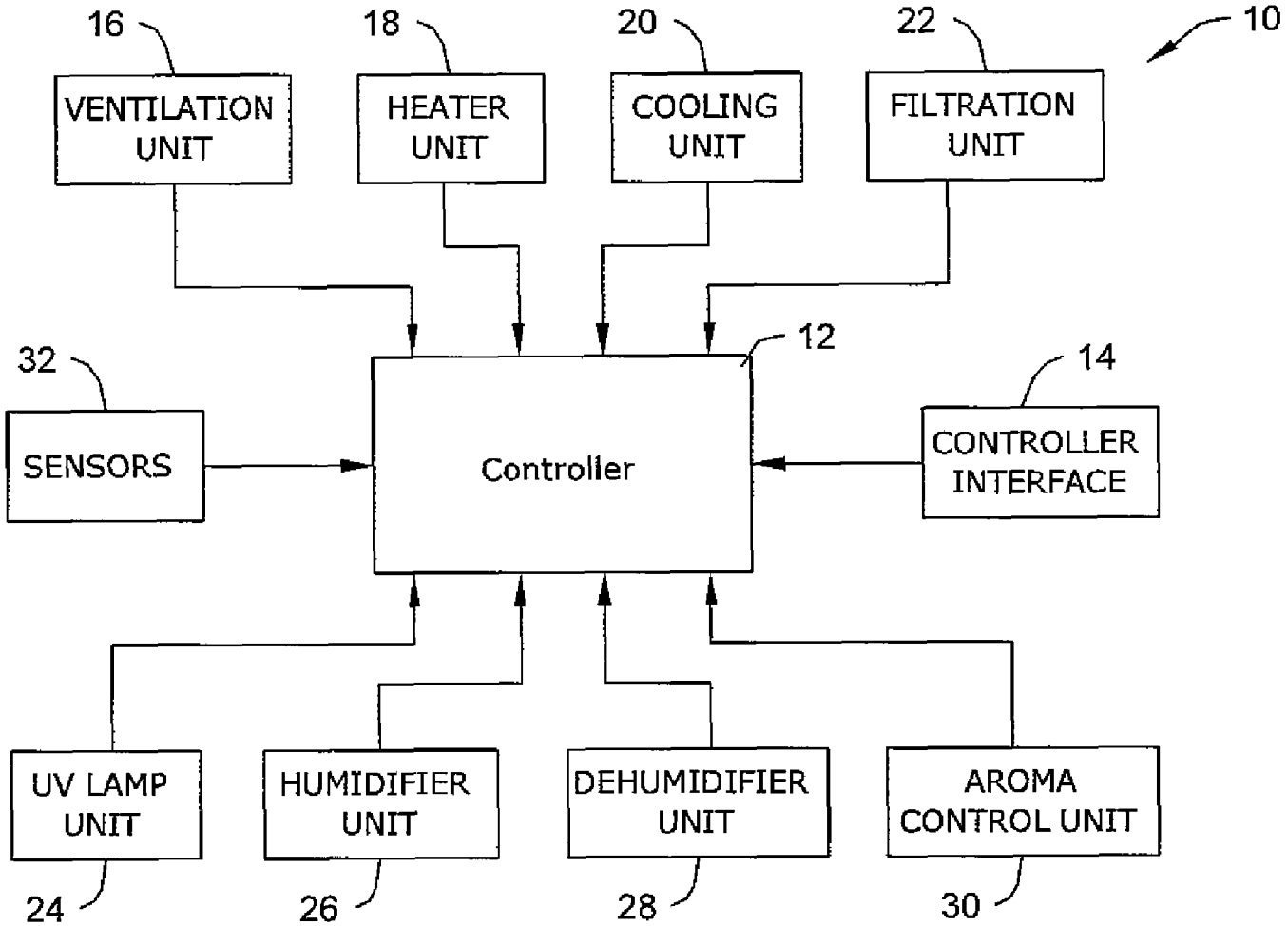
FIG. 1 is a block diagram of an illustrative HVAC system equipped with a controller interface for providing configuration information to a controller.

Referring now to FIG. 1, a block diagram of an illustrative HVAC system 10 equipped with a controller 12 and controller interface 14 will now be described. Controller 12 can be operatively connected to one or more system components that can be activated to regulate various environmental conditions occurring within a structure. As shown in FIG. 1, for example, the controller 12 can be connected to a ventilation unit 16, a heater unit 18, and a cooling unit 20 that can be activated to regulate the temperature and/or venting occurring at one or more zones within the structure. A filtration unit 22, TV lamp unit 24, humidifier unit 26, dehumidification unit 28, and/or aroma control unit 30 can also be provided to regulate the air quality, moisture levels, and/or aroma within the structure. One or more local and/or remote sensors 32 as well as other system components can also be connected to controller 12 to monitor and regulate the environment, as desired.

The controller 12 can include a controller interface 14 that prompts the user to input data relating to one or more physical parameters of the building or structure to be regulated, allowing the user to program the controller without having an extensive knowledge of HVAC systems or their operation. In certain embodiments, for example, the controller interface 14 can include an input selector such as a knob, slide, button, keypad, touchscreen, DIP switch, jumper, or other suitable input means that can be used to program the controller to operate in a desired manner.

While a single controller 12 and controller interface 14 are shown controlling each of the system components in the illustrative HVAC system 10 of FIG. 1, it should be understood that multiple controllers and/or controller interfaces can be employed. In certain embodiments, for example, a separate controller and controller interface could be used to control the ventilation unit whereas another controller and/or controller interface could be used to control one or more the other HVAC system components. Examples of such configurations can be seen, for example, in FIGS. 5-10, which show several panel layouts that that can be used to provide configuration information to a controller.

Figure 2:
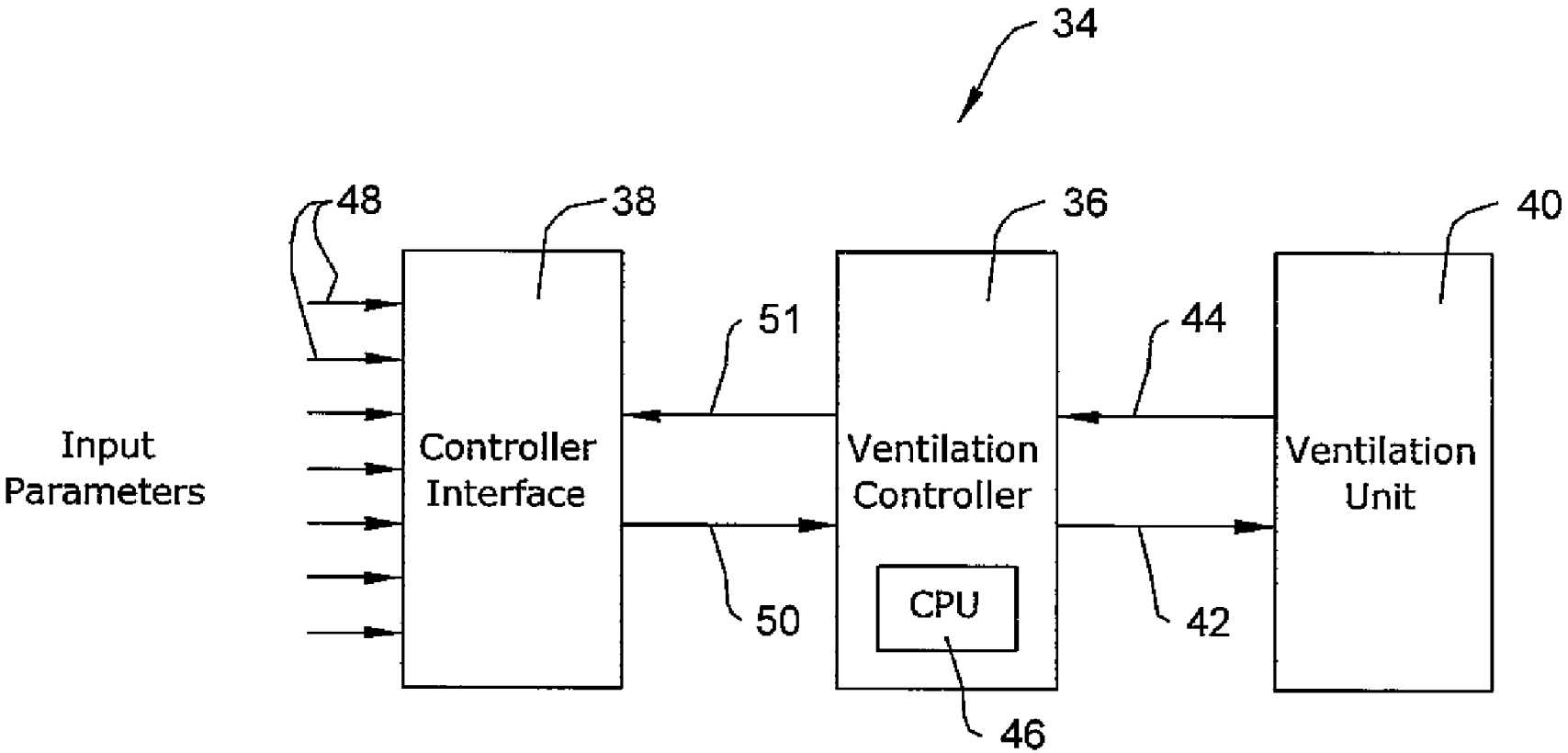
FIG. 2 is a block diagram of an illustrative ventilation system employing a controller equipped with a controller interface.

FIG. 2 is a block diagram of an illustrative ventilation system 34 employing a ventilation controller 36 equipped with a controller interface 38. A ventilation unit 40 operatively coupled to the ventilation controller 36 can include one or more air intake fans and/or exhaust fans that can be selectively activated to deliver fresh air to one or more locations within the structure. The ventilation unit 40 can also include a damper mechanism that can be used to divert the flow of air into selective rooms and/or locations within the structure, allowing fresh air to be channeled into only in those areas where needed. Other components such as a diffuser, humidifier/dehumidifier, filtration system, etc. may also be provided as a part of ventilation unit 40, if desired.

The ventilation controller 36 can be configured to monitor and regulate various operational parameters of the ventilation unit 40. As indicated generally by line 42, the ventilation controller 36 can be configured to send various control parameters and/or signals to the ventilation unit 40 to activate or deactivate one or more of the air intake fans, exhaust fans, dampers, or other system components. In certain embodiments, for example, the ventilation controller 36 can be configured to activate the ventilation unit 40 at certain periods during the day to introduce fresh air into the structure. As indicated generally by line 44, the ventilation unit 40, in turn, can be configured to transmit information back to the ventilation controller 36 regarding the current operational status of the ventilation unit 40 or of other components within the system.

The ventilation controller 36 may include a processor unit 46 (e.g. a CPU/microprocessor) that can be programmed to operate the ventilation unit 40 in a particular manner. In certain embodiments, for example, the processor unit 46 can be programmed to run the ventilation unit 40 on a certain schedule, when fresh air is desired, or at some other desired time and/or event. An illustrative method of ventilating a building or structure in such manner is described in greater detail in co-pending U.S. patent application Ser. No. 10/758,838, which is incorporated herein by reference in its entirety.

The controller interface 38 can be configured to accept one or more input parameters 48 that can be used to control the operation of the ventilation unit 40 as well as other HVAC components, if desired. As indicated generally by line 50, the input parameters received from the controller interface 38 can be transmitted to the ventilation controller 36, which are then either processed by the processor unit 46 and converted into a control parameter for the ventilation unit 40, or delivered directly to the ventilation unit 40. As indicated generally by line 51, the current operational status of the ventilation controller 36 and ventilation unit 40 can then be relayed back to the controller interface 38, allowing the user to monitor and, if necessary, adjust the settings of the ventilation controller 36.

The controller interface 38 may be provided as an integral part of the ventilation controller 36, or may comprise a standalone unit separate from the ventilation controller 36, In certain embodiments, for example, the controller interface 38 may include a knob, slide, button, keypad, touchscreen, DIP switch, jumper, or other suitable input means incorporated within the ventilation controller 36. A computer terminal, PALM™ computer, dial-up host, or other external device may also be used to provide configuration information to the ventilation controller 36, if desired.

Figure 3:
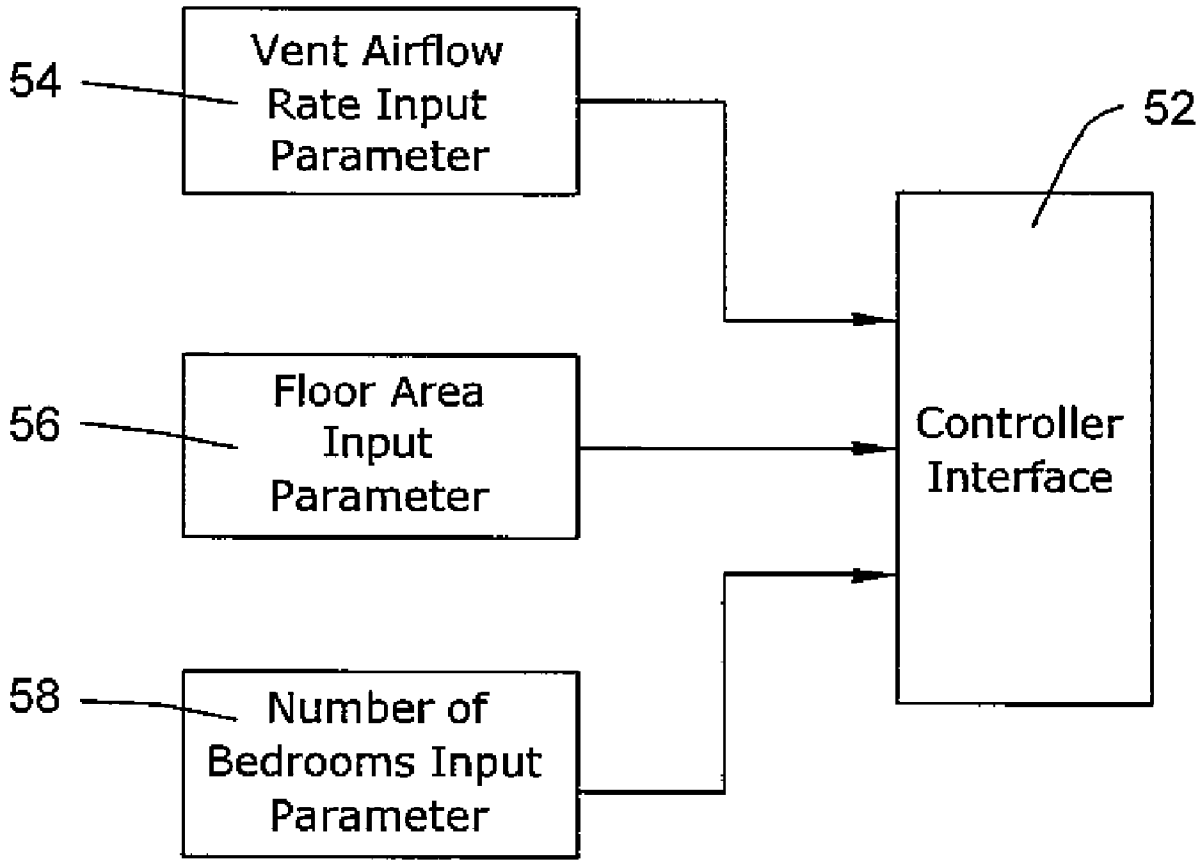
FIG. 3 is a block diagram of an illustrative controller interface configured to accept a number of input parameters for controlling the ventilation within a residential building.

FIG. 3 is a block diagram of an illustrative controller interface 52 configured to accept a number of input parameters for controlling the ventilation within a residential building. As shown in FIG. 3, the controller interface 52 can be configured to receive a VENT AIRFLOW RATE input parameter 54 from the user corresponding to the ventilation airflow rate capability of the ventilation unit within the building during normal operation. The value of this parameter can be readily determined by the user, and can be entered into the controller interface 52 in either English (CFM) or metric (L/s) units, as desired. If, for example, the ventilation airflow rate capability of the ventilation unit is 150 CFM, the controller interface 52 can be configured to accept a VENT AIRFLOW RATE input parameter 54 of "150" using a knob, slide, button, touchscreen, or other input means. In certain embodiments, the ventilation unit can be configured to transmit the set-point value for the VENT AIRFLOW RATE input parameter 54 directly to the controller interface 52, obviating the need for the user to separately input this parameter during installation. In some embodiments, a hard switch (e.g. a DIP switch) or soft switch (e.g. a software generated switch or selector) may be provided to allow the user to select between English (CFM) and metric (L/s) units, if desired The controller interface 52 can be further configured to accept a FLOOR AREA input parameter 56 corresponding to the conditioned floor area of the building to be ventilated, and a NUMBER OF BEDROOMS input parameter 58 corresponding to the number of bedrooms within the building. If, for example, the building to be ventilated has a total conditioned floor area of 2300 square feet with 4 bedrooms, the controller interface 52 can be configured to accept a FLOOR AREA input parameter 56 of "2,300" and a NUMBER OF BEDROOMS input parameter 58 of "4" using a knob, slide, button, touchscreen, or other input means.

While the illustrative embodiment of FIG. 3 depicts three specific input parameters 54,56,58 that can be used to control the ventilation occurring within a building, it should be understood that the controller interface can be configured to accept other input parameters, if desired. The particular input parameters accepted by the controller interface may depend on a number of factors including the type of building or structure to be ventilated, and/or the particular industry and/or governmental standards in effect.

Figure 4:
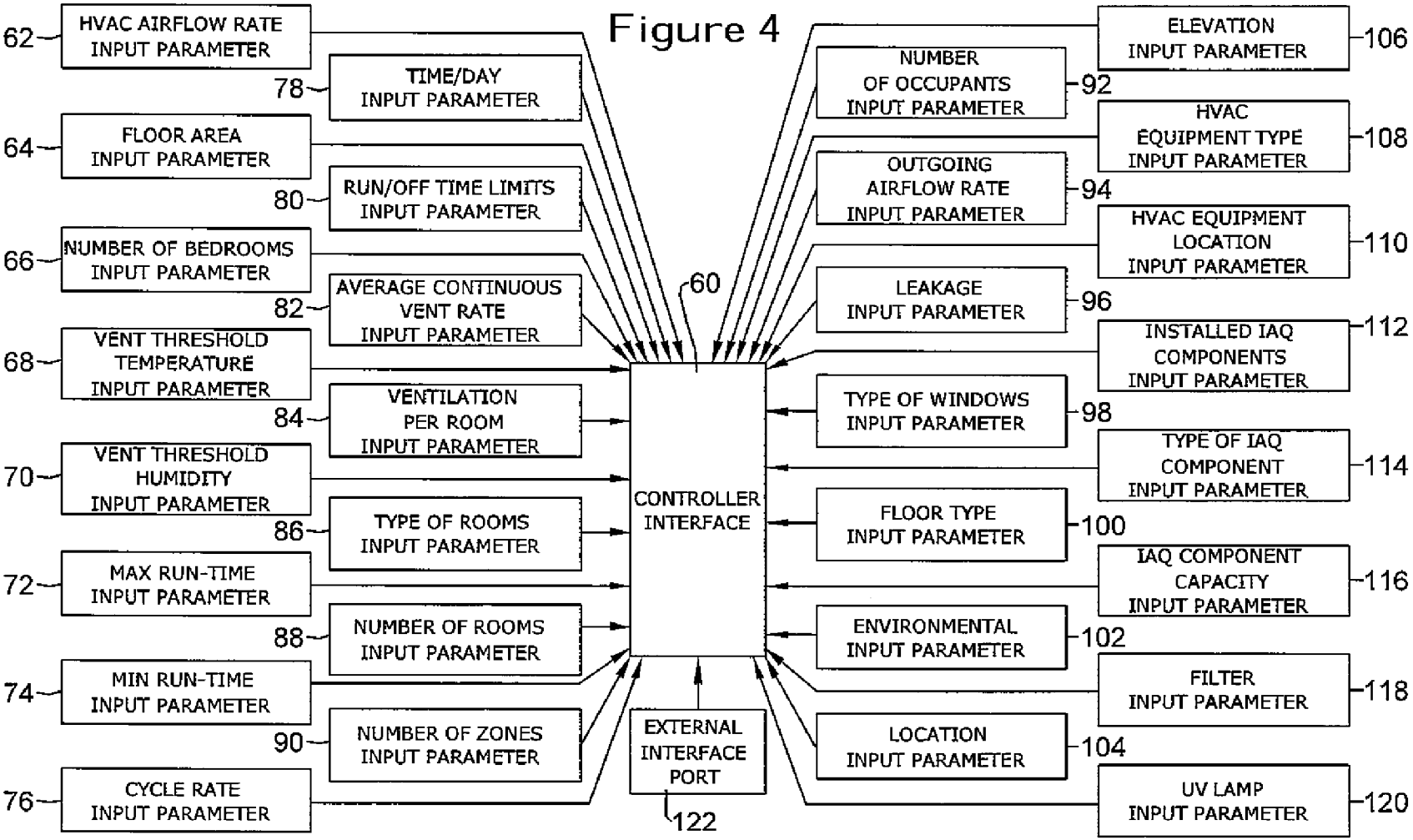
FIG. 4 is a block diagram of another illustrative controller interface configured to accept a number of input parameters for controlling one or more system components within a building or structure.

FIG. 4 is a block diagram of another illustrative controller interface configured to accept a number of input parameters for controlling one or more components of an HVAC system. As shown in FIG. 4, the controller interface 60 can be configured to accept an HVAC AIRFLOW RATE input parameter 62, a FLOOR AREA input parameter 64, and a NUMBER OF BEDROOMS input parameter 66, similar to that described above with respect to FIG. 3.

In addition, the controller interface 60 can be configured to receive a VENT THRESHOLD TEMPERATURE input parameter 68 and a VENT THRESHOLD HUMIDITY input parameter 70, each of which can be used, respectively, to adjust the threshold temperature and humidity level at which the ventilation unit is activated and/or deactivated. If, for example, the user desires to activate the ventilation unit when the temperature reaches a threshold temperature of 80° F., the user may input a set-point value of "80" into the VENT THRESHOLD TEMPERATURE input parameter 68, causing the controller to activate the ventilation unit when the temperature within the building or structure reaches this temperature. Similarly, if the user desires to activate/deactivate the ventilation unit when the humidity level reaches a particular level, the user can input a VENT THRESHOLD HUMIDITY input parameter 70, causing the controller to activate/deactivate the ventilation unit when the humidity reaches a certain value. If desired, the controller interface 60 can permit the user to input the set-point values in either degrees Fahrenheit (° F.) or degrees Celsius (° C.).

The controller interface 60 can also be configured to receive a MAX RUN-TIME input parameter 72 and MIN RUN-TIME input parameter 74, which can be used, respectively, to set the maximum and minimum times that one or more of the HVAC system components operate during any particular hour, day, week, month, or other such time period. If, for example, the user desires the ventilation unit to operate a maximum of 50 minutes per hour and a minimum of 20 minutes per hour, the user may input a set-point value of "20" and "50" into the MAX RUN-TIME and MAX RUN-TIME input parameters 72,74, causing the controller to activate or deactivate the ventilation unit when these values have been met. If desired, a CYCLE RATE input parameter 76 may also be provided to set the maximum and/or minimum rate at which one or more of the HVAC system components cycles on and off during each time period.

A TIME/DAY input parameter 78 of the controller interface 60 can be used to program one or more of the HVAC system components to run on a particular schedule during certain time periods and/or days. If, for example, the user desires to run the ventilation unit from 6:00 P.M. to 8:00 A.M. on weekdays, the TIME/DAY input parameter 78 can be configured to accept set-point values that activate the ventilation unit accordingly. If desired, the controller interface 60 can also be configured to run the ventilation unit at certain, predefined time periods during the day (e.g. morning, afternoon, evening, etc.), reducing the number of programming steps required to set the controller.

Alternatively, or in addition, the controller may have a timer to maintain a current time and/or date. The controller may use the time and/or date to help automatically regulate the building environment. In those embodiments having a ventilation unit, for example, the controller can be configured to increase the overall ventilation during the winter months in cold climate regions, or may increase the ventilation during the daytime versus the nighttime. These are just a few examples of how the controller may use the current time and/or date to help regulate the building environment without or in conjunction with a particular schedule that is entered by the user.

The controller interface 60 can also be configured to accept a RUN/OFF TIME LIMITS input parameter 80 that can be used to control the amount of time that one or more of the HVAC system components operate during each time period. If, for example, the user desires to set the ventilation unit to operate for only 6 hours each day, the RUN/OFF TIME LIMITS input parameter 80 of the controller interface 60 can be configured to accept a set-point value of "6". If desired, the RUN/OFF TIME LIMITS input parameter 80 can also be configured to accept set-point values for other time periods (e.g. minutes per hour, days per week, etc.), or as a percentage of time.

An AVERAGE CONTINUOUS VENT RATE input parameter 82 of the controller interface 60 can be set to control the average continuous vent rate occurring within the building or structure during a particular time period. If, for example, the user desires to set the AVERAGE CONTINUOUS VENT RATE input parameter 82 to a value of 2 air changes per hour (ACH), the user can input a set-point value of "2" into the controller interface 60. If desired, the AVERAGE CONTINUOUS VENT RATE input parameter 82 can also be configured to accept a set-point value expressed as a percentage (e.g. 25% air changeover per hour) or some other desired unit.

The controller interface 60 can be further configured to receive a VENTILATION PER ROOM input parameter 84, a TYPE OF ROOMS input parameter 86, and a NUMBER OF ROOMS input parameter 88, which can be used to adjust the operation of one or more system components (e.g. the ventilation unit) within the building or structure based on the number and type of rooms. Alternatively, or in addition, the ventilation in each or a subset of the rooms may be adjusted based on the number and type of rooms, and the desired ventilation occurring within those rooms. For example, the controller interface 60 may prompt the user to select if the particular rooms to be ventilated are of a certain type (e.g. a main bedroom, spare bedroom, living room, dining room, kitchen, etc.), or of a certain size (e.g. large, medium, small, etc.). The VENTILATION PER ROOM input parameter 84, in turn, can be used to control the amount of ventilation occurring within one or more of the selected rooms, causing a greater or lesser amount of ventilation to occur at those selected areas.

In certain embodiments, the controller interface 60 can be configured to prompt the user to enter a NUMBER OF ZONES input parameter 90, which can be used to select the number of zones and/or HVAC systems operating within the building or structure. If, for example, the structure is partitioned into two zones with separate HVAC systems for each zone, the controller can be configured to accept a NUMBER OF ZONES input parameter 90 of "2", causing the HVAC system to operate in conjunction with the other HVAC system in a desired manner.

A NUMBER OF OCCUPANTS input parameter 92 can be used to adjust the operation of one or more of the HVAC system components based on the anticipated number of occupants within the building or structure. If, for example, the HVAC system includes an aroma control unit for controlling the aroma within a building or structure containing 10 occupants, the controller interface 60 can be configured to accept a NUMBER OF OCCUPANTS input parameter 92 of "10", causing the controller to regulate the aroma control unit in a desired manner based on the occupancy of the room as well as other input parameters described herein.

In certain embodiments, it may be desirable to control the operation of one or more of the HVAC system components based on an OUTGOING AIRFLOW RATE input parameter 94. If, for example, the outgoing airflow rate is anticipated to be approximately 25% of the volume of the building or structure per hour, the controller interface 60 can be configured to accept a set-point value of "25" for the OUTGOING AIRFLOW RATE input parameter 94. This value can then be used to compensate for the loss of airflow and/or pressure within the building or structure, as desired.

A related LEAKAGE input parameter 96 can also be used in addition to, or in lieu of, the OUTGOING AIRFLOW RATE input parameter 94 to compensate for loss of airflow and/or pressure based on the amount of anticipated leakage expected to occur within the building or structure. In certain embodiments, for example, the controller interface 60 can be configured to prompt the user to enter one or more values regarding the air-tightness of the structure (e.g. "tight", "normal", "loose", etc.), the number of windows within the structure (e.g. "10", "15", "20" etc), the type of construction (e.g. "brick", "siding", "stucco", etc.), and/or the R-factor(s) of the building material(s) employed within the building or structure. In some embodiments, the controller interface 60 can also be configured to prompt the user to input whether the building or structure is insulated, and, if so, with what type of material. In use, such configuration information could be used to control the amount of ventilation, heating/cooling, humidification/dehumidification, filtration, etc. occurring within the structure, as desired.

In certain embodiments, the controller interface 60 can be configured to accept a TYPE OF WINDOWS input parameter 98, which can be used to compensate for the type of windows (e.g. single pane, double pane, triple pane, etc.) employed in the structure. If, for example, the structure contains double-paned windows, the controller interface 60 can be configured to prompt the user to input a value of "2×" "double", or other suitable input, causing one or more of the HVAC system components to function in a particular manner. In those embodiments including a humidification/dehumidification unit, for example, such input parameter can be used to adjust the indoor RH limits up or down to maintain a maximum RH that prevents the formation of condensation on the windows.

A FLOOR TYPE input parameter 100 of the controller interface 60 can be used in certain embodiments to provide configuration information to the controller based on the type of flooring material (e.g. hardwood floors, carpeting, tile, etc.) used in the building or structure. If, for example, the structure includes hardwood floors, the controller can be configured to prompt the user to input "hardwood floors" or other such input command into the controller interface 60. Using this information, the controller can be configured to automatically set a minimum RH limit in order to prevent excessive amounts of moisture within the structure from causing damage to the hardwood floors.

An ENVIRONMENTAL input parameter 102 of the controller interface 60 can be used to provide configuration information about various environmental conditions within the building or structure. In certain embodiments, for example, the controller interface 60 can prompt the user to enter whether the occupants have allergies, smoke, own pets, or some other environmental condition within the house. If, for example, the occupant suffers from seasonal allergies, the controller interface 60 can be configured to accept an ENVIRONMENTAL input parameter 102 that causes the controller to increase the amount of UV light and/or ventilation within the building or structure to further clean the air. Based on this information, the controller can determine the minimum run time and/or power necessary to run the various HVAC system components to compensate for the allergies, smoke, pet(s), etc.

Alternatively, or in addition, the controller interface 60 can be configured to prompt the user to enter an ENVIRONMENTAL input parameter 102 relating to the pressure within the building or structure. If, for example, the pressure within the structure is positive, the user may enter an ENVIRONMENTAL input parameter 102 of "positive", "+", or other such input. Conversely, if the pressure within the structure is negative, the user may enter an ENVIRONMENTAL input parameter 102 of "negative", or other such input. During operation, the controller can be configured to adjust one or more of the HVAC system components (e.g. the ventilation unit) to compensate for the pressure within the structure.

A LOCATION input parameter 104 of the controller interface 60 can be configured to receive information from the user regarding the particular climate in which the system operates. In certain embodiments, for example, the controller interface 60 can be configured to prompt the user to input whether the climate is generally hot, cold, dry, humid, moderate, etc., causing various components such as the ventilation unit, heating/cooling units, and the humidification/dehumidification units to operate in a particular manner. If, for example, the HVAC system is to be installed in a hot/dry climate, the controller interface 60 can be configured to accept a LOCATION input parameter 104 of "hot/dry" or other such input command, causing the controller to adjust the operation of the various system components accordingly.

In certain embodiments, the LOCATION input parameter 104 can be configured to prompt the user to enter a telephone area code, zip code, GPS coordinates, or other such number or code signifying the location in which the system is to be operated in. If, for example, the user resides in a locale having a telephone are code of 763, the controller interface 60 can be configured to prompt the user to enter the number "763". The specific number or code entered can be used to initiate a routine or algorithm within the controller that causes the HVAC system to operate in a particular manner based on the inputted locale. In some embodiments, for example, the inputted number or code can cause one or more of the HVAC system components to operate in accordance with the particular governmental an/or industrial standards (e.g. Standard 62.2-2003) in force at the location where the system is to be installed.

An ELEVATION input parameter 106 can be set by the user to adjust the operation of one or system components based on elevation. If, for example, the HVAC system is to operate at an altitude of 2000 ft. above sea level, the user may enter "2000" into the controller interface 60. The controller interface 60 can be configured to accept the ELEVATION input parameter 106 in units of "MSL" (i.e. mean sea level), or some other desired unit. If desired, the controller interface 60 can permit the user to enter set-point values in either English units (e.g. "ft") or SI units (e.g. "m"). In use, the ELEVATION input parameter 106 can be used to adjust the operation of one or more of the HVAC system components including, for example, the relative humidify (RH) produced by the humidifier/dehumidifier units.

An HVAC EQUIPMENT TYPE input parameter 108 and HVAC EQUIPMENT LOCATION input parameter 110 of the controller interface 60 can be used to provide configuration information to the controller regarding the type of HVAC system employed, and the general installation location of the system. The controller interface 60, for example, can be configured to prompt the user to enter a particular type of system (e.g. "Forced Air", "Hydronic", etc.) and/or the installation location of the system (e.g. "attic", "garage", "basement", "closet", "remote site", etc.) If, for example, the HVAC system is a forced air system to be installed in the basement, the user may select an HVAC EQUIPMENT TYPE input parameter 108 of "forced air" and a HVAC EQUIPMENT LOCATION input parameter 110 of "basement" using a knob, slide, button, keypad, touchscreen, DIP switch, jumper, or other suitable input means.

The controller interface 60 can be further configured to accept a number of input parameters relating to the type, capacity, location, as well as other pertinent information regarding other indoor air quality (IAQ) components within the HVAC system. In certain embodiments, for example, the controller interface 60 can be configured to accept an INSTALLED IAQ COMPONENTS input parameter 112 that can be used configure the controller to function properly with one or more IAQ components installed within the HVAC system. The controller interface 60 can prompt the user to input the general type of IAQ product to be installed (e.g. a "filtration unit", "UV lamp unit", "humidifier unit", "dehumidifier unit", "aroma control unit", etc.).

A TYPE OF IAQ COMPONENT input parameter 114 of the controller interface 60, in turn, can be configured to provide the controller with information about the each particular IAQ component installed within the HVAC system. If, for example, the user indicates via the INSTALLED IAQ COMPONENTS input parameter 112 that the HVAC system is to include a ventilation unit, a humidification unit, and a dehumidifier unit, the controller interface 60 can be configured to prompt the user to enter the type of ventilation unit (e.g. forced air vs. ERV/HRV), humidification unit (e.g. drum, bypass, steam, etc.) and dehumidification unit (e.g. a desiccant or DX-type dehumidifier) to be used. Alternatively, or in addition, the controller interface 60 can prompt the user to enter the brand name and/or model number of each IAQ component within the system, causing the controller to automatically configure the IAQ component to function properly with the other components in the system.

In some embodiments, the controller interface 60 can also be configured to prompt the user to input the type of installation for one or more of the installed IAQ products. If, for example, a dehumidifier unit is installed within the system, the controller interface 60 can be configured to prompt the user to input whether the component operates as stand alone unit, in a supply-return bypass configuration, or in some other configuration. In use, such input parameter can be used, for example, to control the manner in which the dampers open and close during operation.

In certain applications, it may be desirable for the controller interface 60 to accept an IAQ COMPONENT CAPACITY input parameter 116 to provide the controller with information regarding the product capability of one or more of the IAQ components installed within the system. If, for example, the system includes a humidification unit and dehumidification unit, the controller interface 60 can be configured to prompt the user to input set-point values related to the humidifier unit capacity (e.g. "GPD") and dehumidifier unit capacity (e.g. "PPD"). In similar fashion, if the system includes a UV lamp unit, the controller interface 60 can be configured to prompt the user to input the lamp wattage capacity (e.g. "50 Watts") specified by the manufacturer of the UV lamp unit.

In those embodiments including a filtration unit, the controller interface 60 can also be configured to accept a FILTER input parameter 118, prompting the user to enter information relating, for example, to the type of air cleaner employed (e.g. EAC, media, etc.), the initial pressure drop across the filter (e.g. "psi" or "Pa"), the holding capability of the filter (e.g. "lbs" or "kg"), and/or the maximum filter pressure drop across the filter (e.g. "psi" or "Pa"). Using the maximum filter pressure drop value provided by the manufacturer, for example, the controller can be programmed to monitor the pressure drop across the filter using a pressure transducer or other suitable measuring device, and then output a signal to the controller interface 60 prompting the user to change the filter when the pressure drop reaches a certain upper limit.

In those embodiments including a UV lamp unit, the controller interface 60 can be similarly configured to accept a UV LAMP input parameter 120 that can be used to provide configuration information regarding the mounting location of the UV lamp (e.g. on the AC cooling coil or at or near the air return), the UV lamp wattage, etc. The controller can be configured to accept one or more values that, when used in conjunction with other input parameters such as the HVAC AIRFLOW RATE input parameter 62, can be used to determine how much time the UV lamp unit and/or ventilation unit should operate. If, for example, the airflow rate were set at a relatively high position, the controller can be configured to run the UV lamp unit for a longer period of time to increase the kill rate of particulates within the flow of air.

An external interface port 122 of the controller interface 60 can be configured to receive one or more input parameters from other system components, if desired. In certain embodiments, for example, the external interface port 122 can be configured to accept one or more input parameters from another HVAC controller or system component, allowing the user to adjust that controller and/or system component via the controller interface 60.

Figure 5:
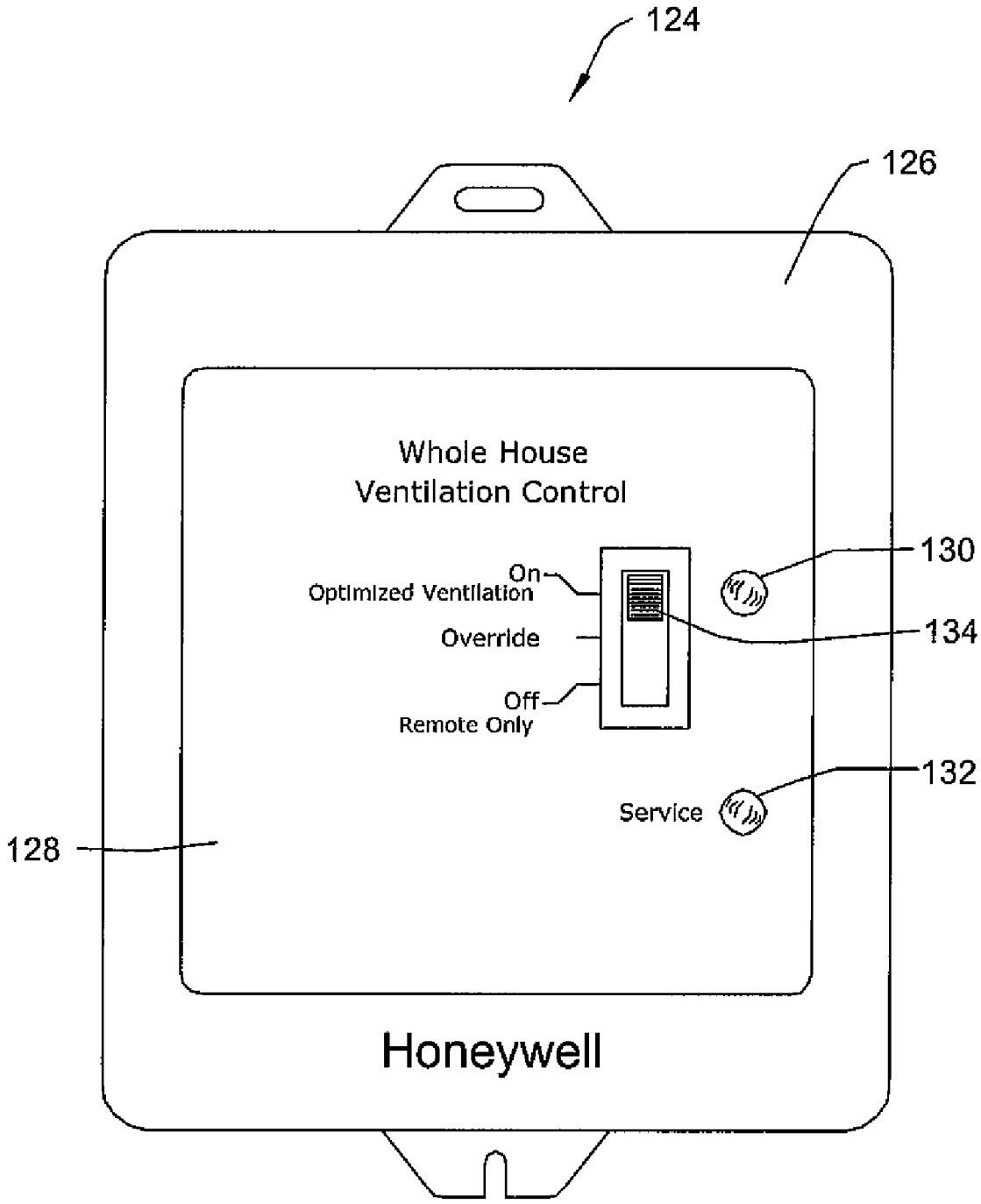
FIG. 5 is a front view of an illustrative ventilation controller equipped with a controller interface.

Referring now to FIG. 5, an illustrative ventilation controller 124 equipped with a controller interface will now be described. As illustrated in FIG. 5, the ventilation controller 124 may include a housing 126 that encloses a processor unit, a controller interface, contact terminals as well as other components of the controller 124. In the illustrative embodiment, a front panel 128 of the of the housing 126 exposes a light emitting diode (LED) 130 or other suitable visual indicator adapted to indicate the current operational state of the ventilation controller 124. In some embodiments, for example, the LED 130 can be configured to remain on to indicate that the ventilation controller 124 is currently on and/or off to indicate that the ventilation controller 124 is currently off. In some cases, the LED 130 can be adapted to blink or flash to indicate that service may be required or that an internal fault has been detected. Alternatively, the front panel 128 may expose another light emitting diode (LED) 132 or other suitable visual indicator adapted to indicate that the ventilation controller 124 may need service. In the illustrative embodiment, the front panel 128 may also expose a switch 134, which can be used, for example, to manually activate, deactivate and/or change the operating mode (e.g. on, override, off) of the ventilation controller 124, if desired.

Figure 6:
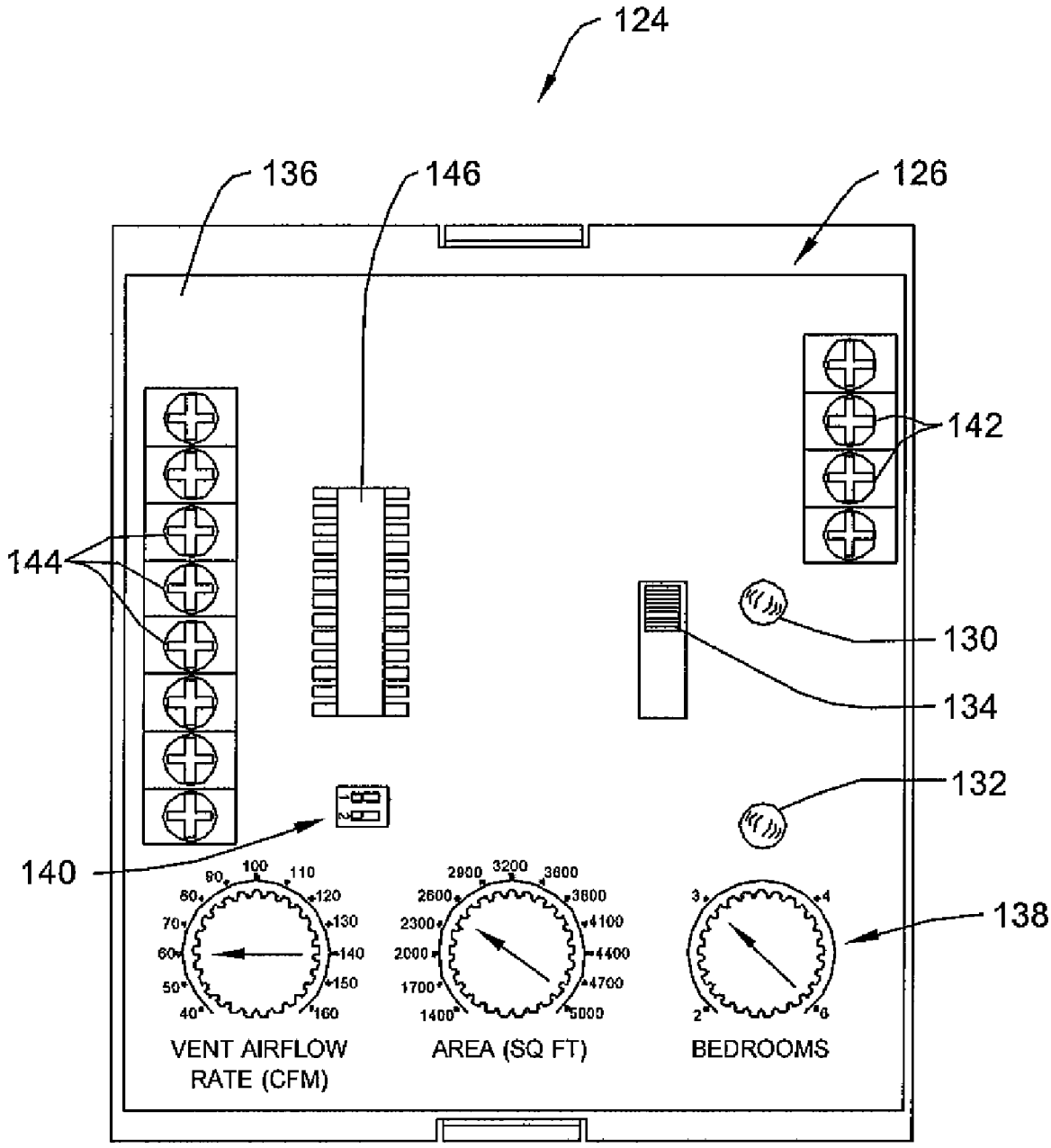
FIG. 6 is a front view showing the interior of the ventilation controller of FIG. 5.

FIG. 6 is a front view showing the interior of the ventilation controller 124 of FIG. 5. As shown in FIG. 6, the front panel 128 of the housing 126 can be opened or removed to permit access to an interior portion of the housing 126. A circuit board 136 or the like disposed within the housing 126 may support a number of components including the LED's 130, 132 and the switch 134 illustrated in FIG. 5. The circuit board 136 (or the like) may also support a controller interface 138 that can be used to set various input parameters used by the ventilation controller 124 to monitor and regulate the ventilation unit, as well as switches 140 or the like that can be used to select one or more other parameters such as the minimum and/or maximum ventilation rate, a particular ventilation algorithm or standard to meet (e.g. Standard 62.2-2003 or other ventilation algorithm), units of measure (e.g. English (CFM) versus metric (L/s) units) and/or any other desired parameter. In an illustrative embodiment, the switches 140 may be DIP switches or any other type of switch or selector, as desired.

In the illustrative embodiment, a number of power supply terminals 142 can be used to provide power to the ventilation controller 124. Several I/O terminals 144 on the circuit board 136 or the like can also be used to send and/or receive signals to and/or from the ventilation unit as well as other components of the HVAC system, including, for example, an air conditioner, heater, fan, humidifier/dehumidifier, etc. The LED's 130,132, switch 134, controller interface 138, switches 140, power supply terminals 142, I/O terminals 144, as well as other components supported by the circuit board 136 or the like can be electrically connected a processor unit 146 such as a CPU/microprocessor, which can be utilized to convert the one or more input parameters into one or more control signals for the ventilation unit and/or other HVAC components, as desired.

Figure 7:
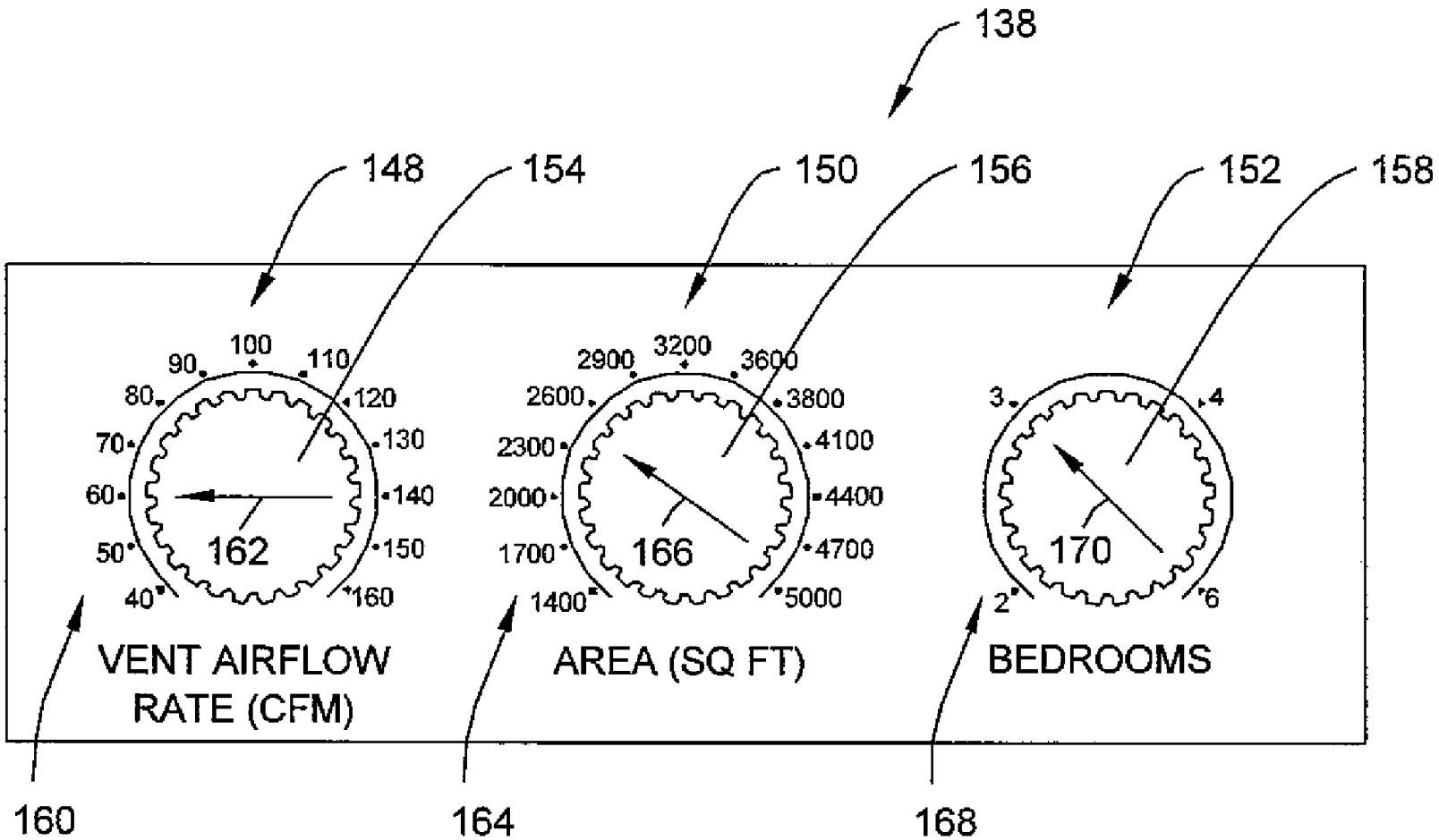
FIG. 7 is a plan view showing the controller interface of FIG. 6 in greater detail.

FIG. 7 is a plan view showing the illustrative controller interface 138 of FIG. 6 in greater detail. As shown in FIG. 7, and in the illustrative embodiment, controller interface 138 may include a ventilation airflow rate input selector 148, a floor area input selector 150, and a number of bedrooms input selector 152. The input selectors 148,150,152 may each include a respective knob 154,156,158 that can be rotated in either a clockwise or counterclockwise direction to adjust various set-point values within the ventilation controller 124. In certain embodiments, the knobs 154,156,158 may each comprise a rotary potentiometer that can be used to adjust the settings of the respective input selector 148,150,152 in any number of positions, allowing the user to fine tune the particular set-point value desired. In other embodiments, the knobs 154,156,158 may comprise a rotary switch, linear sliders, or other input means, allowing the user to select between several positions or values. In some embodiments, the resolution of the knobs 154,156,158 can be selected to strike a balance between ease of use and a desired amount of precision.

As can be further seen in FIG. 7, the ventilation airflow rate input selector 148, total area input selector 150, and number of bedrooms input selector 152 can each include a correspondingly marked scale informing the user of the current set-point value selected. A first scale 160 corresponding to the ventilation airflow rate (CFM) of the ventilation unit, for example, may be positioned adjacent to the ventilation airflow rate input knob 154 to inform the user the current ventilation airflow rate set-point selected. An arrow 162 or other suitable indicator on the ventilation airflow rate input knob 154 can be configured to point to the current set-point selected on the scale 160, indicating the current value selected. In similar fashion, a second and third scale 164,168 corresponding, respectively, to the total area and number of bedrooms to be controlled, may be positioned adjacent to the area input selector 150 and number of bedrooms input selector 152, informing the user of the current area and number of bedrooms selected. As with the ventilation airflow rate input knob 154, the total area input knob 156 and number of bedrooms input knob 158 may also include a respective arrow 166,170 or other indicator means that can be used to indicate the current set-point value selected on each scale 164,168.

To program one or more set-points on the controller interface 138, the user can adjust the input selectors 148,150,152 by turning the appropriate knob 154,156,158 either clockwise or counterclockwise, as desired. To increase the ventilation airflow rate set-point value within the ventilation controller 124 from an initial default value of 60 CFM illustrated in FIG. 7 to a higher value (e.g. 110 CFM), for example, the user may rotate the ventilation airflow rate input selector knob 154 clockwise until the arrow 162 aligns with the set-point "110" displayed on the scale 160. In similar fashion, to increase the total area to be ventilated from 2450 square feet illustrated in FIG. 7 to a higher value of 3800 square feet, for example, the user may rotate the total area input selector knob 156 clockwise until the arrow 166 aligns with set-point "3800" displayed on the scale 164. Moreover, if, for example, the user desires to reduce the number of bedrooms from an initial default position of three bedrooms illustrated in FIG. 7 to two bedrooms, the user may rotate the number of bedrooms input selector knob 158 counterclockwise until the arrow 170 aligns with the set-point "2" on the scale 168.

While English units are specifically illustrated in the embodiment of FIG. 7, it should be understood that metric (SI) units could be used in addition to, or in lieu of, the units illustrated. Moreover, while specific set-point values are illustrated, it should be understood that other values could be displayed on the scales 160,164,168, as appropriate to the particular application. If, for example, the ventilation controller 124 is to be used in larger buildings or structures, the scales 104,108,110 can be configured to display greater set-point values than those shown in FIG. 7. If desired, an optional multiplier selector (not shown) can also be provided adjacent one or more of the input selectors 148,150,152 to increase or decrease the value of the scale 160,164,168 by a particular multiplier (e.g. 2, 4, ½, ¼, etc.).

Figure 8:
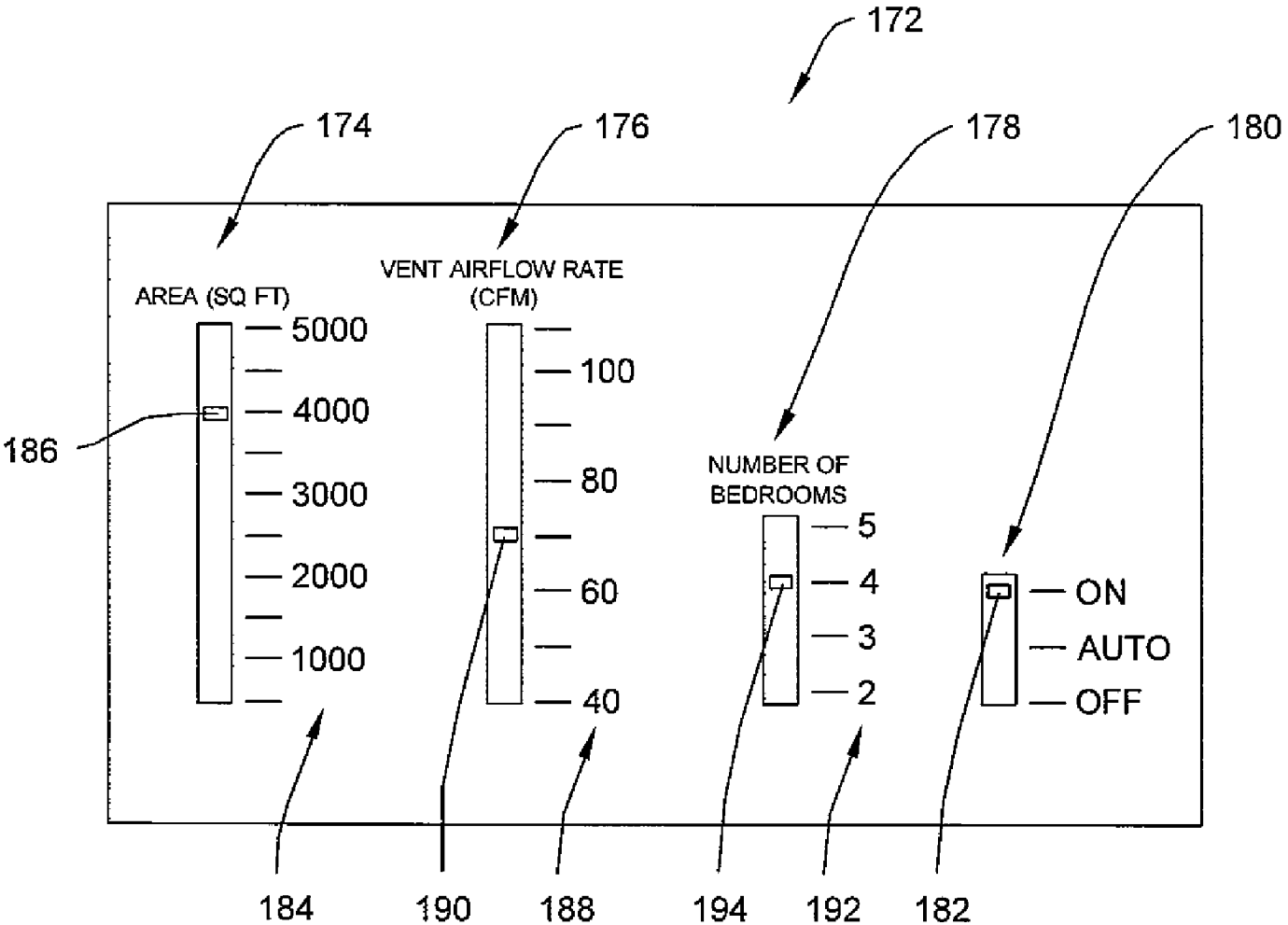
FIG. 8 is a plan view showing another illustrative controller interface equipped with a number of slide input selectors.

FIG. 8 is a plan view showing another illustrative controller interface 172 equipped with a number of slide input selectors. As shown in FIG. 8, controller interface 172 can include a total area slide input selector 174, a ventilation airflow rate slide input selector 176, and a number of bedrooms slide input selector 178. The slide input selectors 174,176,178 may each comprise a linear potentiometer that can be adjusted in any number of infinite positions, or a slide switch or other incremental input means that allows the user to select between several discrete positions. A switch 180 equipped with a slide element 182 can also be provided to toggle the ventilation controller 124 between an on position, an off position, and an auto position.

Each of the slide input selectors 174,176,178 may include a correspondingly marked scale informing the user of the current set-point value selected. A first scale 184 positioned adjacent the area slide input selector 174 can be used in conjunction with a slide 186 to adjust the current area set-point value selected. In similar fashion, a second and third scale 188,192 corresponding, respectively, to the ventilation airflow rate of the ventilation unit and the number of bedrooms to be controlled may be positioned adjacent to the ventilation airflow rate slide input selector 176 and number of bedrooms slide input selector 178, informing the user of the ventilation airflow rate and number of bedrooms selected. As with the area slide input selector 174, the ventilation airflow rate slide input selector 176 and number of bedrooms slide input selector 178 may each include a respective slide 190, 194.

Operation of the controller interface 172 is similar to that described above with respect to FIG. 7. To adjust the settings on each of the slide input selectors 174,176,178, the user may advance the desired slide 186,190,194 in a particular direction until aligned with the desired set-point value on the corresponding scale 184,188,192. In the particular view illustrated in FIG. 8, for example, the user may increase the ventilation airflow rate set-point value from 70 CFM depicted in FIG. 8 to a higher set-point value by moving the slide 190 upwardly until aligned with the new desired set-point value. Adjustment of the area slide input selector 174 and number of bedrooms slide input selector 178 can be accomplished in a similar manner by aligning the appropriate slide 186,194 with the desired set-point value displayed on the scale 184,192.

Figure 9:
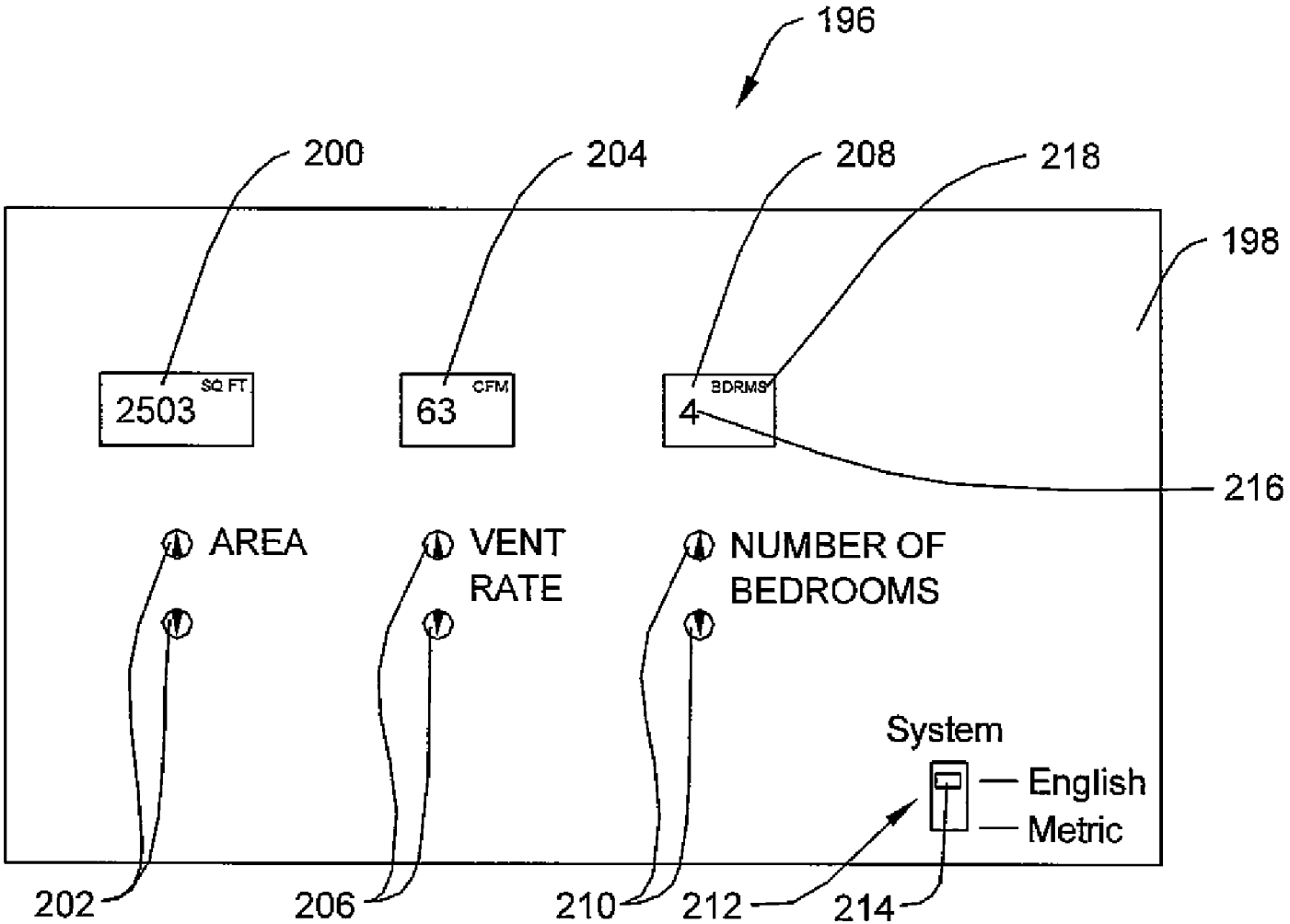
FIG. 9 is a plan view showing another illustrative controller interface having a number of display panels and keypads.

FIG. 9 is a plan view showing another illustrative controller interface 196 having a number of display panels and keypads. As shown in FIG. 9, the controller interface 196 may include a front panel 198 having a first display panel 200 (e.g. an LCD panel, LED panel, CRT) and set of up/down arrow buttons 202 that can be used to adjust the total area of the building or structure to be ventilated. In similar fashion, a second display panel 204 and third display panel 208 may each include a corresponding set of up/down arrow buttons 206,210 that can be used to adjust the ventilation airflow rate capability of the ventilation unit along with the number of bedrooms located within the building or structure. In certain embodiments, a unit system select switch 212 equipped with a slide 214 or other suitable input means can be used to toggle the set-point values displayed on first and second display panels 200,204 between English or metric (SI) units, as desired.

To program the various set-point values for the ventilation controller 196, the user may depress the appropriate one of the up/down arrow buttons 202,206,210 located below each display panel 200,204,208 until the desired set-point value is displayed. To increase the number of bedrooms to be ventilated, for example, the user may press the up arrow button 210 one or more times until the desired number of bedrooms is displayed on the third display panel 208. The set-point value 216 currently selected by the user can be displayed on the display panel 208 along with a unit icon 218 indicating the particular units (i.e. English or metric) selected.

Figure 10:
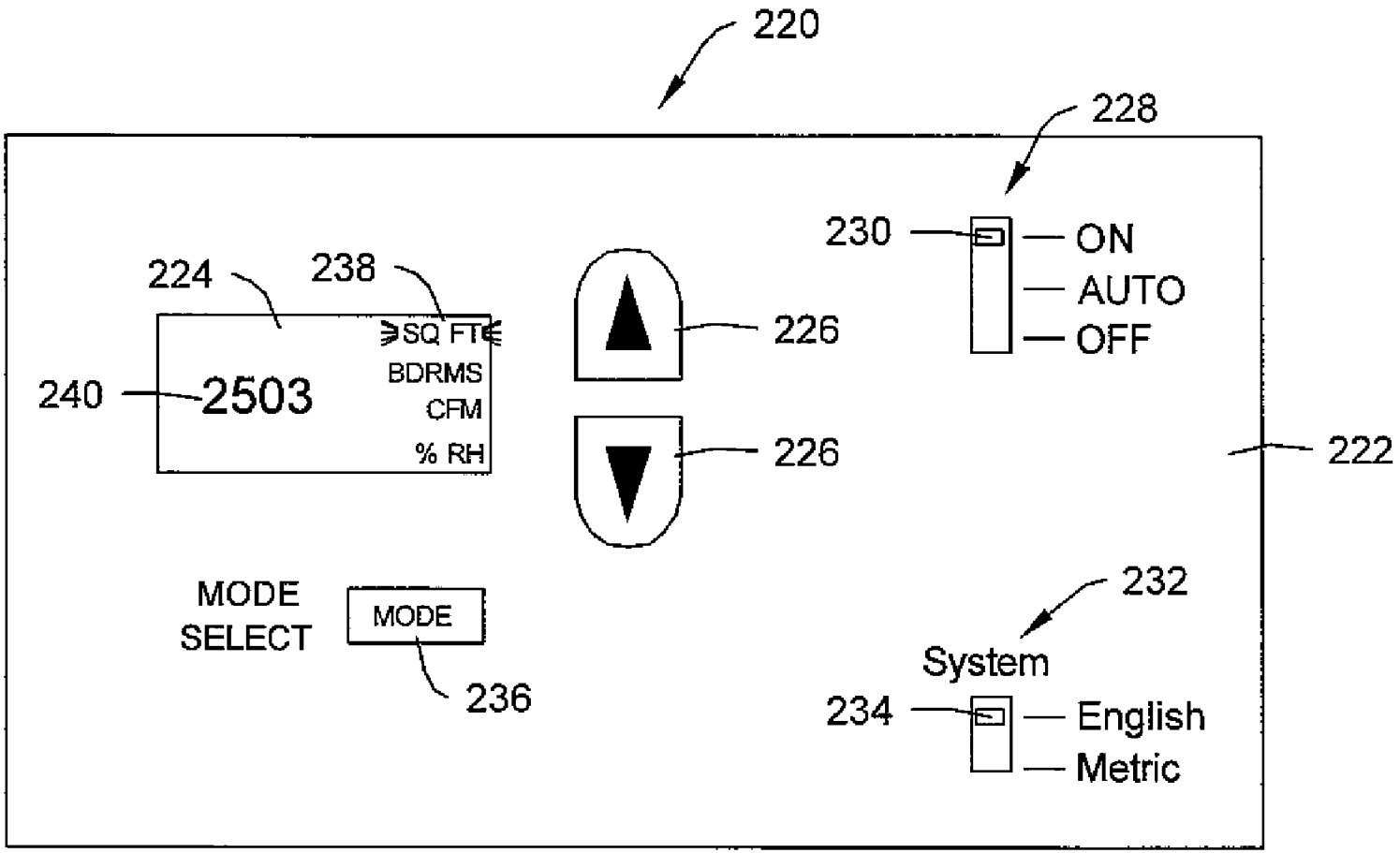
FIG. 10 is a plan view showing another illustrative controller interface having a single display panel and keypad configuration.

FIG. 10 is a plan view showing another illustrative controller interface 220 having a single display panel and keypad configuration. As shown in FIG. 10, the controller interface 220 may include a front panel 222 having a single display panel 224 configured to display multiple set-point values programmed within the ventilation controller. A set of up/down arrow buttons 226 on the front panel 224 can be used to adjust the various settings of the ventilation controller, including, for example, an area set-point value, a number of bedrooms set-point value, a ventilation airflow rate set-point value, and a humidity set-point value. An on/off/auto switch 228 on the front panel 222 can be equipped with a slide 230 or other suitable input means to toggle the ventilation controller between an on position, an off position, and an auto position. A unit system selector switch 232 equipped with a slide 234 may also be provided to switch between English or metric (SI) units on the display panel 224, as desired.

To display the various set-point values on the display panel 224, the user can depress a mode select button 236 one or more times until the desired set-point value is displayed on the display panel 224. Each time the mode select button 236 is depressed by the user, an icon 238 or other visual indicator may appear on the display panel 224 along with a set-point value 240 corresponding to the current input parameter being programmed. As shown in FIG. 10, for example, the mode select button 236 can be pressed one or more times until the set-point value 240 of "2503" is displayed on the display panel 224 along with a blinking "SQ FT" icon 238 indicating that the currently selected input parameter is the total area to be ventilated.

To change the currently selected set-point value 240 to another value, the user may depress the appropriate up/down arrow button 226 until the new desired set-point value 240 is displayed on the display panel 224. If, for example, the user desires to change the area set-point value from "2503" illustrated in FIG. 10 to a lower value, the user may press the down arrow button 226 one or more times until the desired set-point value 240 appears on the display panel 224.

To change the other input parameters programmed within the ventilation controller, the user may depress the mode select button 236 one or more times until the desired set-point value 240 is displayed on the display panel 224. The controller interface 220 can be configured to cycle through the various input parameters in a particular order. In certain embodiments, for example, the controller interface 220 can be configured to cycle through a total area input parameter, a number of bedrooms input parameter, a ventilation airflow input parameter, and a humidity input parameter with each successive press of the mode select button 236. As with other embodiments described herein, the controller interface 220 can be configured to accept set-point values corresponding to other input parameters, if desired.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes can be made with respect to various elements described herein without exceeding the scope of the invention.

What is claimed is:

1. A ventilation system for use in ventilating a building or structure, comprising:

a ventilation unit;

a controller configured to control the ventilation unit; and a controller interface configured to accept one or more input parameters corresponding to a direct physical parameter of the building or structure, wherein said one or more input parameters includes an area input parameter and/or a number of bedrooms input parameter; and wherein said one or more input parameters further includes one or more parameters selected from the group of a ventilation airflow rate input parameter, a ventilation per room input parameter, a type of room input parameter, an outgoing airflow rate input parameter, a type of rooms input parameter, a number of rooms input parameter, a number of zones input parameter, a number of occupants input parameter, a leakage input parameter, a type of windows input parameter, a floor type input parameter, an environmental input parameter, a location input parameter, an elevation input parameter, an HVAC equipment type input parameter, an HVAC equipment location input parameter, an installed IAQ components input parameter, a type of IAQ component input parameter, an IAQ component capacity input parameter, a filter input parameter, and a UV lamp input parameter.

2. The ventilation system of claim 1, wherein said one or more input parameters includes the area input parameter, the number of bedrooms input parameter, and a ventilation airflow rate input parameter.

3. The ventilation system of claim 1, wherein said one or more parameters may also be selected from the group of a vent threshold temperature input parameter, a vent threshold humidity input parameter, a max run-time input parameter, a min run-time input parameter, a cycle rate input parameter, a time/day input parameter, a run/off time limits input parameter, and an average continuous vent rate input parameter.

4. The ventilation system of claim 1, wherein the controller includes a processor unit configured to convert the one or more input parameters received from the controller interface into one or more control parameters for controlling the ventilation unit.

5. The ventilation system of claim 4, wherein the one or more control parameters corresponds to one or more control signals.

6. The ventilation system of claim 1, wherein the controller is a programmable controller.

7. The ventilation system of claim 1, further comprising input means for inputting the one or more input parameters into the controller interface.

8. The ventilation system of claim 7, wherein said input means includes at least one rotary knob.

9. The ventilation system of claim 7, wherein said input means includes at least one slide.

10. The ventilation system of claim 1, wherein the controller interface includes at least one display panel and keypad.

11. The ventilation system of claim 10, wherein said at least one display panel and keypad comprises a plurality of display panels each equipped with a corresponding keypad configured to accept an input parameter.

12. The ventilation system of claim 10, wherein said at least one display panel and keypad comprises a single display panel and keypad.

13. The ventilation system of claim 1, further comprising a selector to specify a maximum ventilation parameter.

14. The ventilation system of claim 1, further comprising a selector to specify a minimum ventilation parameter.

15. The ventilation system of claim 1, further comprising one or more input selectors to select between two or more ventilation control algorithms for use by the controller.

16. The ventilation system of claim 15, wherein the one or more input selectors are configured to accept the one or more input parameters in multiple levels or selections.

17. The ventilation system of claim 1, wherein the building or structure is a residential building or structure.

18. The ventilation system of claim 1, wherein the building or structure is a commercial building or structure.

19. A ventilation system for use in ventilating a building or structure, comprising:

a ventilation unit;

a programmable controller configured to receive one or more input parameters corresponding to a direct physical parameter of the building or structure, wherein said one or more input parameters include an area input parameter and/or a number of bedrooms input parameter, the programmable controller including a processor unit configured to convert the one or more input parameters into one or more control parameters for the ventilation unit; and input means for inputting the one or more input parameters into the programmable controller; and wherein said one or more input parameters further includes one or more parameters selected from the group of a ventilation airflow rate input parameter, a ventilation per room input parameter, a type of room input parameter, an outgoing airflow rate input parameter, a type of rooms input parameter, a number of rooms input parameter, a number of zones input parameter, a number of occupants input parameter, a leakage input parameter, a type of windows input parameter, a floor type input parameter, an environmental input parameter, a location input parameter, an elevation input parameter, an HVAC equipment type input parameter, an HVAC equipment location input parameter, an installed IAQ components input parameter, a type of IAQ component input parameter, an IAQ component capacity input parameter, a filter input parameter, and a UV lamp input parameter.

20. The ventilation system of claim 19, wherein said one or more input parameters includes the ventilation airflow rate input parameter.

21. The ventilation system of claim 19, wherein said one or more parameters may also be selected from the group of a vent threshold temperature input parameter, a vent threshold humidity input parameter, a max run-time input parameter, a min run-time input parameter, a cycle rate input parameter, a time/day input parameter, a run/off time limits input parameter, and an average continuous vent rate input parameter.

22. The ventilation system of claim 19, wherein said input means comprises a controller interface.

23. The ventilation system of claim 19, wherein the one or more control parameters corresponds to one or more control signals.

24. The ventilation system of claim 19, wherein said input means includes at least one rotary knob.

25. The ventilation system of claim 19, wherein said input means includes at least one slide.

26. The ventilation system of claim 19, wherein the input means is configured to select between a number of discrete values.

27. The ventilation system of claim 19, wherein the input means is configured to provide a value from a continuum of values.

28. The ventilation system of claim 19, wherein the input means includes an input selector to select between two or more units of measure.

29. The ventilation system of claim 28, wherein the input selector selects between English and metric units of measure.

30. The ventilation system of claim 19, wherein the input means is configured to accept the one or more input parameters in multiple levels or selections.

31. The ventilation system of claim 19, wherein the building or structure is a residential building or structure.

32. The ventilation system of claim 19, wherein the building or structure is a commercial building or structure.

33. A programmable controller for controlling a ventilation unit of a building or structure, the controller comprising:

one or more input selectors configured to accept one or more values corresponding to a direct physical parameter of the building or structure, the one or more values corresponding to an area value and/or a number of bedrooms value;

the one or more input selectors also configured to accept one or more input parameters selected from the group of: a ventilation airflow rate input parameter, a ventilation per room input parameter, a type of room input parameter, an outgoing airflow rate input parameter, a type of rooms input parameter, a number of rooms input parameter, a number of zones input parameter, a number of occupants input parameter, a leakage input parameter, a type of windows input parameter, a floor type input parameter, an environmental input parameter, a location input parameter, an elevation input parameter, an HVAC equipment type input parameter, an HVAC equipment location input parameter, an installed IAQ components input parameter, a type of IAQ component input parameter, an IAQ component capacity input parameter, a filter input parameter, and a UV lamp input parameter; and a processor unit for controlling the operation of the ventilation unit based at least in part on the values received from the one or more input selectors.

34. The controller of claim 33, wherein said one or more input selectors includes at least one rotary knob.

35. The controller of claim 33, wherein said one or more input selectors includes at least one slide.

36. The controller of claim 33, wherein each of said one or more input selectors includes at least one display panel and keypad.

37. The controller of claim 33, wherein said one or more input selectors includes a single display panel and keypad.

38. The controller of claim 33, wherein the processor unit is configured to convert the values received from the one or more input selectors into one or more control parameters for controlling the ventilation unit.

39. The controller of claim 33, wherein said one or more input selectors comprises a plurality of input selectors.

40. The controller of claim 39, wherein said plurality of input selectors includes a ventilation airflow rate input selector, an area input selector, and a number of bedrooms input selector.

41. The controller of claim 33, wherein the controller is a ventilation controller.

42. The controller of claim 33, wherein the controller is an HVAC controller.

43. A controller interface for setting one or more parameters within a ventilation controller, comprising:

one or more input selectors configured to select an area parameter value, a number of bedrooms parameter value and one or more of a ventilation airflow rate input parameter value, a ventilation per room input parameter value, a type of room input parameter value, an outgoing airflow rate input parameter value, a type of rooms input parameter value, a number of rooms input parameter value, a number of zones input parameter value, a number of occupants input parameter value, a leakage input parameter value, a type of windows input parameter value, a floor type input parameter value, an environmental input parameter value, a location input parameter value, an elevation input parameter value, an HVAC equipment type input parameter value, an HVAC equipment location input parameter value, an installed IAQ components input parameter value, a type of IAQ component input parameter value, an IAQ component capacity input parameter value, a filter input parameter value, and a UV lamp input parameter value; and display means for displaying the current parameter value selected by each of the one or more input selectors.

44. The controller interface of claim 43, wherein said one or more input selectors includes at least one rotary knob.

45. The controller interface of claim 43, wherein said one or more input selectors includes at least one slide.

46. The controller interface of claim 43, wherein said display means includes a scale.

47. The controller interface of claim 43, wherein said display means includes a display panel.

48. A method of operating a ventilation unit of a building or structure, comprising:

interacting with a controller equipped with a controller interface having one or more input selectors that are configured to accept one or more parameter values that each correspond to a direct physical parameter of the building or structure, wherein the one or more parameter values includes an area parameter value and/or a number of bedrooms parameter value, and also one or more of a ventilation airflow rate input parameter value, a ventilation per room input parameter value, a type of room input parameter value, an outgoing airflow rate input parameter value, a type of rooms input parameter value, a number of rooms input parameter value, a number of zones input parameter value, a number of occupants input parameter value, a leakage input parameter value, a type of windows input parameter value, a floor type input parameter value, an environmental input parameter value, a location input parameter value, an elevation input parameter value, an HVAC equipment type input parameter value, an HVAC equipment location input parameter value, an installed IAQ components input parameter value, a type of IAQ component input parameter value, an IAQ component capacity input parameter value, a filter input parameter value, and a UV lamp input parameter value;

adjusting the one or more input selectors to set the one or more parameter values of the controller; and controlling the ventilation unit of the building or structure utilizing the one or more parameter values that correspond to the direct physical parameters of the building or structure.

49. The method of claim 48, further comprising the step of converting the one or more parameter values received from the one or more input selectors into one or more control parameters that are used to control the operation of the ventilation unit.

50. The method of claim 48, further comprising the step of displaying the one or more parameter values on a display panel of the controller interface.

51. A method for providing configuration information to a controller used to control a ventilation unit of a building or structure, comprising:

providing a controller equipped with a controller interface having one or more input selectors configured to accept one or more parameter values that correspond to a direct physical parameter of the building or structure, wherein the one or more parameter values includes an area parameter value and/or a number of bedrooms parameter value, and also one or more of a ventilation airflow rate input parameter value, a ventilation per room input parameter value, a type of room input parameter value, an outgoing airflow rate input parameter value, a type of rooms input parameter value, a number of rooms input parameter value, a number of zones input parameter value, a number of occupants input parameter value, a leakage input parameter value, a type of windows input parameter value, a floor type input parameter value, an environmental input parameter value, a location input parameter value, an elevation input parameter value, an HVAC equipment type input parameter value, an HVAC equipment location input parameter value, an installed IAQ components input parameter value, a type of IAQ component input parameter value, an IAQ component capacity input parameter value, a filter input parameter value, and a UV lamp input parameter value;

adjusting the one or more input selectors to set the one or more parameter values of the controller; and converting the one or more parameter values received from the one or more input selectors into one or more control parameters that are used by a control algorithm of the controller to control the operation of the ventilation unit.

52. A method for providing configuration information to a controller used to control a ventilation unit of a building or structure, comprising:

providing a controller equipped with a controller interface having one or more input selectors;

inputting at least one parameter value into the controller corresponding to a direct physical parameter of the building or structure, wherein the at least one parameter value includes an area parameter value and/or a number of bedrooms parameter value, and also one or more of a ventilation airflow rate input parameter value, a ventilation per room input parameter value, a type of room input parameter value, an outgoing airflow rate input parameter value, a type of rooms input parameter value, a number of rooms input parameter value, a number of zones input parameter value, a number of occupants input parameter value, a leakage input parameter value, a type of windows input parameter value, a floor type input parameter value, an environmental input parameter value, a location input parameter value, an elevation input parameter value, an HVAC equipment type input parameter value, an HVAC equipment location input parameter value, an installed IAQ components input parameter value, a type of IAQ component input parameter value, an IAQ component capacity input parameter value, a filter input parameter value, and a UV lamp input parameter value; and converting the inputted parameter values into one or more control parameters that are used by a control algorithm of the controller to control the operation of the ventilation unit.

53. A method for providing configuration information to a controller used to control a ventilation unit of a building or structure, comprising:

providing a controller equipped with a controller interface;

inputting a first set-point value into the controller interface, the first set-point value corresponding directly to the area of the building or structure to be ventilated;

inputting a second set-point value into the controller interface, the second set-point value corresponding to one of the following input parameters: a ventilation airflow rate unit input parameter, a ventilation per room input parameter, a type of room input parameter, an outgoing airflow rate input parameter, a type of rooms input parameter, a number of rooms input parameter, a number of zones input parameter, a number of occupants input parameter, a leakage input parameter, a type of windows input parameter, a floor type input parameter, an environmental input parameter, a location input parameter, an elevation input parameter, an HVAC equipment type input parameter, an HVAC equipment location input parameter, an installed IAQ components input parameter, a type of IAQ component input parameter, an IAQ component capacity input parameter, a filter input parameter, and a UV lamp input parameter; and inputting a third set-point value into the controller interface, the third set-point value corresponding directly to the number of bedrooms within the building or structure converting the inputted set-point values into one or more control parameters that help control the operation of the ventilation unit.

* * * * *